US012305637B2

(12) United States Patent
Saich et al.

(10) Patent No.: US 12,305,637 B2
(45) Date of Patent: May 20, 2025

(54) CONDENSATE PUMP ASSEMBLY

(71) Applicant: Aspen Pumps Limited, East Sussex (GB)

(72) Inventors: Claire Saich, East Sussex (GB); Jack Mabon, East Sussex (GB)

(73) Assignee: Aspen Pumps Limited, East Sussex (GB)

( * ) Notice: Subject to any disclaimer, the term of this patent is extended or adjusted under 35 U.S.C. 154(b) by 107 days.

(21) Appl. No.: 18/100,210

(22) Filed: Jan. 23, 2023

(65) Prior Publication Data

US 2023/0228265 A1 Jul. 20, 2023

(30) Foreign Application Priority Data

Jan. 24, 2022 (GB) ..... 2200863

(51) Int. Cl.

| | |
|---|---|
| ***F04B 53/22*** | (2006.01) |
| ***F04B 17/03*** | (2006.01) |
| ***F04B 23/02*** | (2006.01) |
| ***F04B 53/16*** | (2006.01) |
| ***F04D 13/16*** | (2006.01) |
| ***F04D 29/42*** | (2006.01) |
| ***F04D 29/58*** | (2006.01) |

(Continued)

(52) U.S. Cl.

CPC ..... *F04B 53/22* (2013.01); *F04B 17/03* (2013.01); *F04B 23/026* (2013.01); *F04B 53/16* (2013.01);

(Continued)

(58) Field of Classification Search

CPC ..... F04D 13/16; F04D 29/605; F04D 29/606; F04D 29/607; F04D 29/628; F24F 13/222;

(Continued)

(56) References Cited

U.S. PATENT DOCUMENTS 6,322,326 B1 11/2001 Davis et al.
2007/0224050 A1* 9/2007 Ward ..... F04D 15/0218 417/41

(Continued)

FOREIGN PATENT DOCUMENTS

CN 203560109 U 4/2014
CN 106704213 A 5/2017

(Continued)

OTHER PUBLICATIONS

Yan et al, 'Condensate Pump'—Machine Translation of CN 203560109, Apr. 2014 (Year: 2014).*

(Continued)

*Primary Examiner* — Kenneth J Hansen
(74) *Attorney, Agent, or Firm* — Taft Stettinius & Hollister LLP

(57) ABSTRACT

A condensate pump assembly comprising: a housing having an inlet port, a reservoir arranged to receive liquid through the inlet port, and an outlet port having an outlet assembly mounted thereto, a pump arranged to pump liquid from reservoir to the liquid outlet assembly, and a pair of clips releasably connectable to the housing at a first pair of mounting portions and a second pair of mounting portions, wherein each of the pair of clips has a first portion for connecting to a first external element and a second portion for connecting to a second external element, wherein the pair of clips are configured to mount the housing to the first external element when connected to the first pair of mounting portions, and wherein the pair of clips are configured to mount the housing to the second external element when connected to the second pair of mounting portions.

10 Claims, 8 Drawing Sheets

(51) Int. Cl.
*F04D 29/60* (2006.01)
*F24F 13/22* (2006.01)

(52) U.S. Cl.
CPC ..... *F04D 13/16* (2013.01); *F04D 29/4293* (2013.01); *F04D 29/5806* (2013.01); *F04D 29/605* (2013.01); *F24F 13/222* (2013.01)

(58) Field of Classification Search
CPC .... F04B 53/22; F16B 2/20; F16B 7/22; F16B 45/00
USPC ..... 248/201, 304
See application file for complete search history.

(56) References Cited

U.S. PATENT DOCUMENTS

2008/0142674 A1 6/2008 Dang et al.
2011/0061415 A1* 3/2011 Ward ..... F04B 49/04 700/282
2011/0085917 A1 4/2011 Ward
2017/0363317 A1 12/2017 Constable et al.

FOREIGN PATENT DOCUMENTS

GB 2591477 A 8/2021
WO 2020160042 A1 8/2020

OTHER PUBLICATIONS

Combined Search and Examination Report for corresponding Application No. GB2200863.5 dated Jun. 20, 2022, 6 pages.
Search Report for corresponding Application No. GB2200863.5 dated Feb. 2, 2023, 4 pages.
European Search Report for corresponding Application No. 23151499.3 dated Sep. 29, 2023, 7 pages.

* cited by examiner

CONDENSATE PUMP ASSEMBLY

CROSS REFERENCE TO RELATED APPLICATIONS

This is a U.S. Non-Provisional Application that claims priority to UK Patent Application s/n GB2200863.5, filed Jan. 24, 2022, the contents of which is incorporated herein by reference its entirety.

This invention relates to a condensate pump assembly.

BACKGROUND

Condensate pump assemblies are installed at different sites, such as against external walls or ducting, or on different external elements, such as stud bars. Prior art condensate pumps have addressed this problem by making different versions of the same pump or by including a range of fasteners to account for the different installation sites. However, both prior art solutions are wasteful as unused fasteners will be thrown away and manufacturing different versions of the same pump to account for different installation sites is undesirable.

Prior art pump outlet members have one barbed end which connects to a discharge line, and a second threaded end to screw the outlet to the pump body. However, when these pumps need to be removed, for example, for servicing, the installer must twist the discharge line to unscrew the barbed outlet from the pump. This is particularly difficult as discharge lines are often braided tubes which are stiff, and therefore resist twisting of the outlet. The removal of the barbed outlet is made more difficult by the fact condensate pump assemblies are often installed in space-constrained areas which will place further strain on the installer when removing the condensate pump assembly.

Prior art pumps typically include a motor and other electrical components which generate heat in use. However, as the pumps are designed to be in close proximity to liquids, it is undesirable to include large openings to cool the electrical components in case water reaches the electrical components. The lack of openings can often limit the ability of prior art pumps to remain cool.

The present invention seeks to address at least some of these issues.

BRIEF SUMMARY OF THE DISCLOSURE

Viewed from a first aspect, the present invention provides a condensate pump assembly comprising: a housing having an inlet port, a reservoir arranged to receive liquid through the inlet port, and an outlet port having an outlet assembly mounted thereto, a pump arranged to pump liquid from reservoir to the liquid outlet assembly, and a pair of clips releasably connectable to the housing at a first pair of mounting portions and a second pair of mounting portions. Each of the pair of clips has a first portion for connecting to a first external element and a second portion for connecting to a second external element. The pair of clips are configured to mount the housing to the first external element when connected to the first pair of mounting portions. The pair of clips are configured to mount the housing to the second external element when connected to the second pair of mounting portions.

Each clip of the pair of clips may comprise a hook portion for engaging a corresponding tab portion of the housing.

Any of the first pair of mounting portions or second pair of mounting portions may comprise a recess arranged to receive the hook portion of a respective clip in a first direction and allow the clip to translate in a second direction different to the first direction so as to engage the tab portion.

The first pair of mounting portions may comprise a resiliently deformable member arranged to urge the hook portion against the tab portion.

The clip may comprise an aperture having a first portion having a profile corresponding to the first external element and a second portion having a profile corresponding to the second external element.

The housing may comprise a lower section comprising the reservoir and an upper section. The first pair of mounting portions and second pair of mounting portions may be formed in the upper section. Having the mounting portions on the upper section allows the wired and/or plumbed in part of the condensate pump assembly to remain in place, while the lower section (typically containing the reservoir) can be unclipped and/or removed, emptied and cleaned.

The first pair of mounting portions may be arranged on opposed sides of the housing.

The second pair of mounting portions may be arranged on a side of the housing.

The pair of clips may be arranged in a first orientation when connected to the first pair of mounting portions. The clips may be arranged in a second orientation when connected to the second pair of mounting portions. The first orientation may be substantially perpendicular to the second orientation. The first orientation may be horizontal in use. The second orientation may be substantially vertical in use.

The first external element may be an elongate member, such as a stud bar or threaded rod.

The second external element may be a fastener for mounting the condensate pump assembly to a planar surface, such as a vertical plane or an appliance. The vertical plane may be a wall of a room or ducting. The fastener may be a screw, nail, hook or similar fastener that can be anchored to the planar surface onto which the clip may be mounted.

The pump may be arranged to pump liquid to the outlet assembly through a pumping chamber of the housing. The pumping chamber may have an outlet extending through the outlet port to connect to the outlet assembly. The outlet assembly may comprise an outlet member for connecting to a discharge line and a locking element arranged to releasably engage the outlet of the pumping chamber so as to releasably secure the outlet member to the outlet of the pumping chamber.

Viewed from a further independent aspect, there is provided a condensate pump assembly comprising: a housing having an inlet port, a reservoir arranged to receive liquid through the inlet port, and an outlet port having an outlet assembly mounted thereto, and a pump arranged to pump liquid from reservoir to the outlet assembly. The pump is arranged to pump liquid to the outlet assembly through a pumping chamber of the housing. The pumping chamber has an outlet extending through the outlet port to connect to the outlet assembly. The outlet assembly comprises an outlet member for connecting to a discharge line and a locking element arranged to releasably engage the outlet of the pumping chamber so as to releasably secure the outlet member to the outlet of the pumping chamber.

The outlet assembly may comprise a sealing element disposed between the outlet member and the outlet of the pumping chamber. The sealing element may be a piston seal. The outlet member may comprise a barbed section.

The outlet assembly may comprise a one-way valve. The one-way valve may be mounted to the outlet member such that the one-way valve remains attached to the outlet member when the outlet member is released from the outlet of the pumping chamber. The outlet member may comprise a barbed end for connecting to the discharge line. The outlet member may comprise a non-threaded end opposed to the barbed end.

The locking element may comprise a threaded section for engaging a corresponding threaded section of the outlet of the pumping chamber.

The housing may comprise an upper section and a lid mounted to the upper section. The condensate pump assembly may comprise a pump motor mounted on the upper section and arranged to drive the pump. A gap may be maintained between the lid and the upper section such that air can flow to the pump motor from outside the housing.

Viewed from a further independent aspect, there is provided a condensate pump assembly comprising: a housing having an inlet port, a reservoir arranged to receive liquid through the inlet port, and an outlet port having an outlet assembly mounted thereto, and a pump arranged to pump liquid from reservoir to the outlet assembly. The pump is arranged to pump liquid to the outlet assembly through a pumping chamber of the housing. The housing comprises an upper section and a lid mounted to the upper section. The condensate pump assembly comprises a pump motor mounted on the upper section and arranged to drive the pump. A gap is maintained between the lid and the upper section such that air can flow to the pump motor from outside the housing.

The upper section may comprise a wall extending away from an upper surface of the upper section and at least partially circumscribing the pump motor. The lid may comprise an internal surface having a plurality of fins arranged to abut the wall to maintain the gap. The gap may be less than 7 mm, for example between 3 mm and 7 mm.

The plurality of fins may be spaced equally around the lid. Adjacent pairs of the plurality of fins may be spaced by a distance of between 2 mm and 100 mm. The plurality of fins may be spaced by a distance of approximately 13.5 mm. This spacing advantageously reduces motor heating, thus increasing the duty cycle of the pump.

At least a part of the lid may provide an overhang over the wall.

BRIEF DESCRIPTION OF THE DRAWINGS

Embodiments of the invention are further described hereinafter with reference to the accompanying drawings, in which.

DETAILED DESCRIPTION

Figure 1:
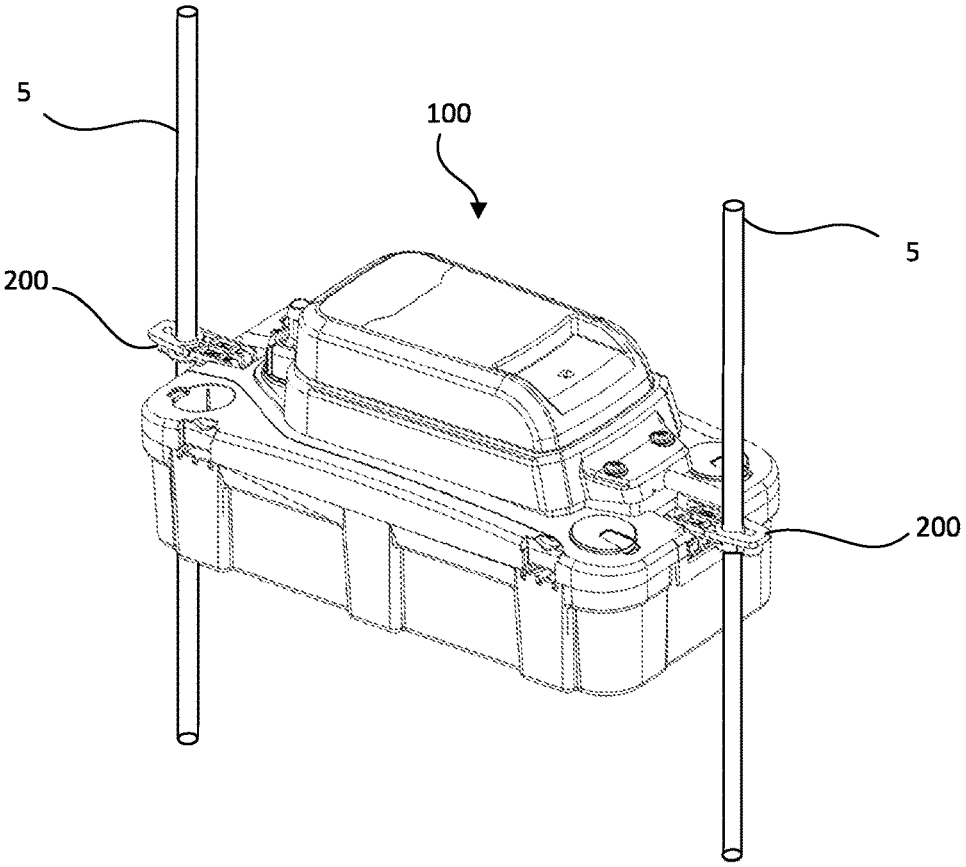
FIGS. 1 & 2 illustrate perspective views of an exemplary condensate pump assembly with clips which enable connection to stud bars and a planar surface respectively.
Figure 2:
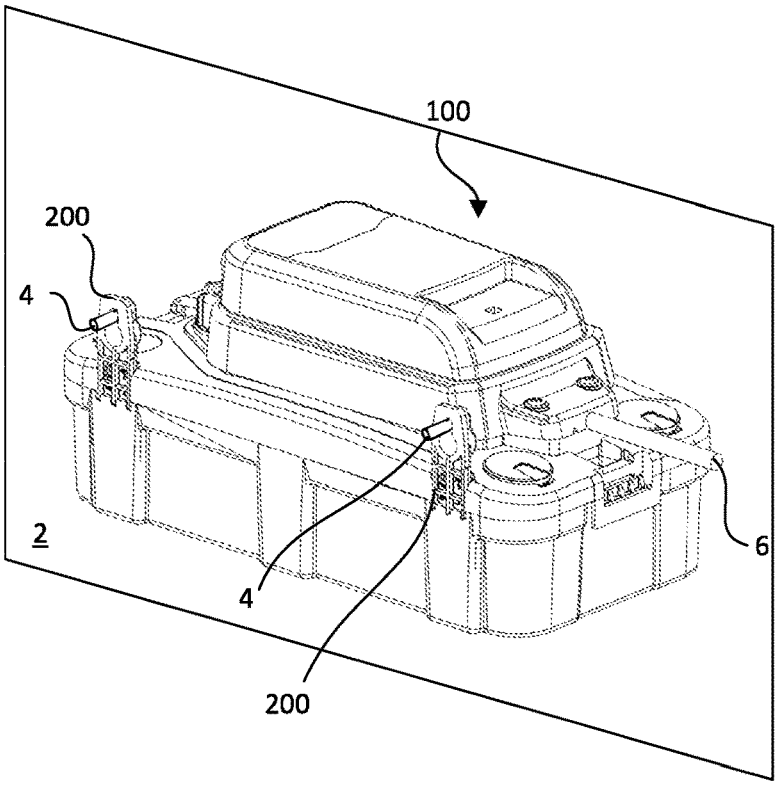
Figure 6A:
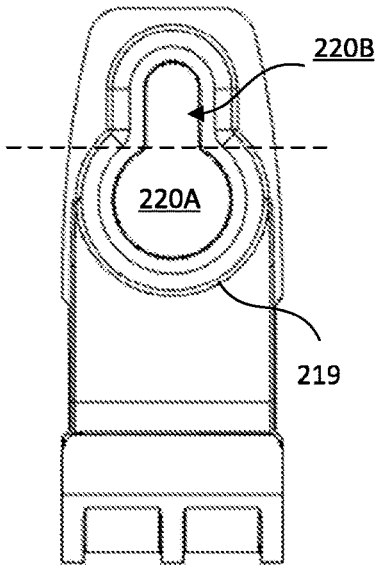
FIGS. 6A to 6C illustrate front, side and rear views of an exemplary clip.

FIGS. 1 & 2 illustrate perspective views of an exemplary condensate pump assembly 100 with clips 200 which enable connection to different external elements (e.g. a stud bar 5 or a fastener 4) via different mounting positions 155A, 155B (see FIG. 3) on the condensate pump assembly 100. When connected to a fastener 4, the clip 200 enables connection to a planar surface 2, such as a wall or an appliance (e.g. a casing of an air-conditioner unit) respectively. When the clips 200 are mounted vertically as shown in FIG. 2, the fastener 4 connects the condensate pump assembly 100 to the planar surface 4. The condensate pump assembly 100 can also be mounted to stud bar 5 using the clips 200 mounted in the horizontal position shown in FIG. 1. This can be achieved by an installer first securing suitable fixings (e.g. nuts) to the stud bar 5 such that the clip 200 can rest on the fixing to hold the condensate pump assembly 100 at the correct height. The condensate pump assembly 100 may be provided pre-assembled with the clips 200 mounted horizontally (as shown in FIG. 1), vertically (as shown in FIG. 2), or separately to the condensate pump assembly 100, such that the installer must mount the clips 200 to the condensate pump assembly 100 when installing the condensate pump assembly 100 for the first time. The clips 200 have a raised section 219 having an aperture 220 formed therein (see FIG. 6A). The aperture 220 has two portions 220A, 220B which enable the clip to be connected to different external elements 4, 5. For example, the stud 5 may have a diameter corresponding to the first portion 220A. The fastener 4 used to connect the clip 200 to the planar surface 2 may have a second diameter corresponding to the second portion 220B. While round fasteners 4 and stud bar 5 have been described herein, it would be apparent this was merely exemplary, and the aperture 220 may have a profile corresponding to different shaped external elements. A screw 4 is a suitable fastener for mounting the condensate pump assembly 100 to the wall 2. As the two aperture portions 220A, 220B are connected to one another, the head of the screw is able to pass through the first portion 220A of the aperture 220 and the condensate pump assembly can be lowered such that the screw shaft can be slide into the second portion 220B. The screw can then be tightened to fix the condensate pump assembly 100 to the wall 2. Should it be necessary to remove the condensate pump assembly 100 from the wall, an installer simply needs to loosen the screws 4, as opposed to fully removing the screws, so that the condensate pump assembly 100 can be lifted and removed from the screws 4 while the screws remain in place. The first 200A and second 220B portions are shown having a round cross section with different diameters. This advantageously allows the same clip 200 to be used with different stud 5 (e.g. 8 mm and 10 mm stud bar), while also allowing for fastening to a screw 4 as explained above. The present clip 200 can be made from injection moulding, as the design has the same line-of-draw for both orientations of the clip 200.

Figure 3:
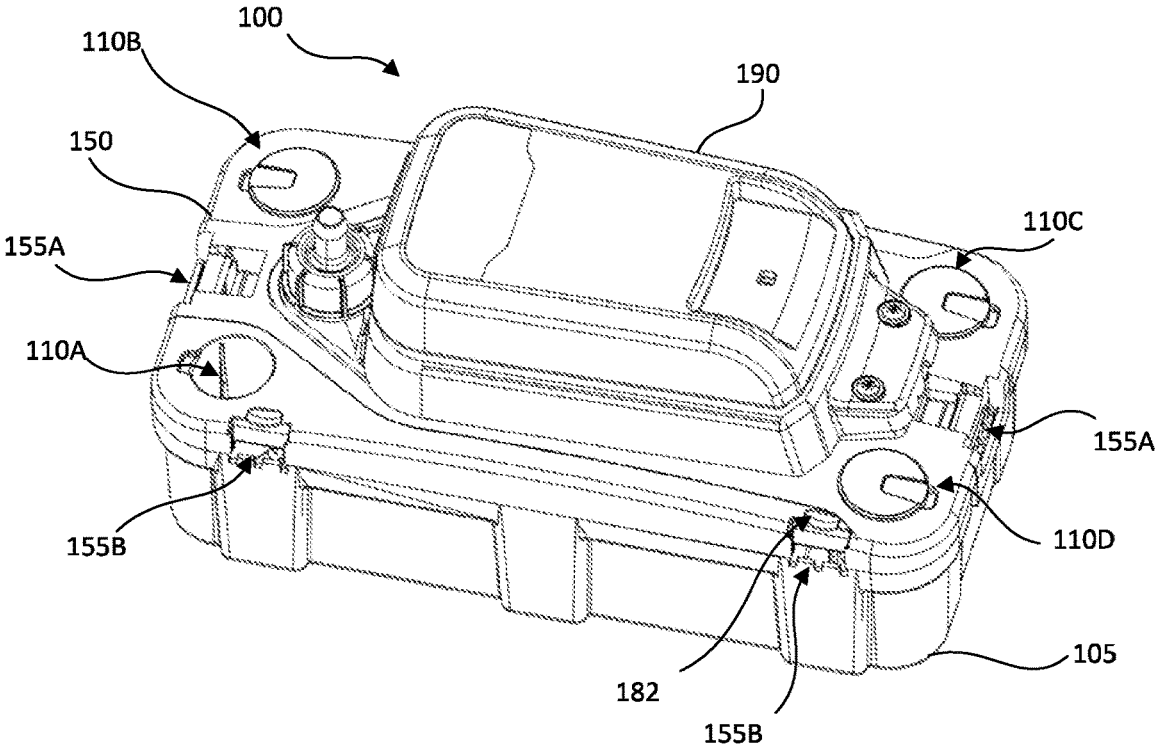
FIGS. 3 & 4 illustrate perspective and cross-sectional views of the pump assembly of FIGS. 1 and 2 with the clips omitted for clarity.
Figure 4:
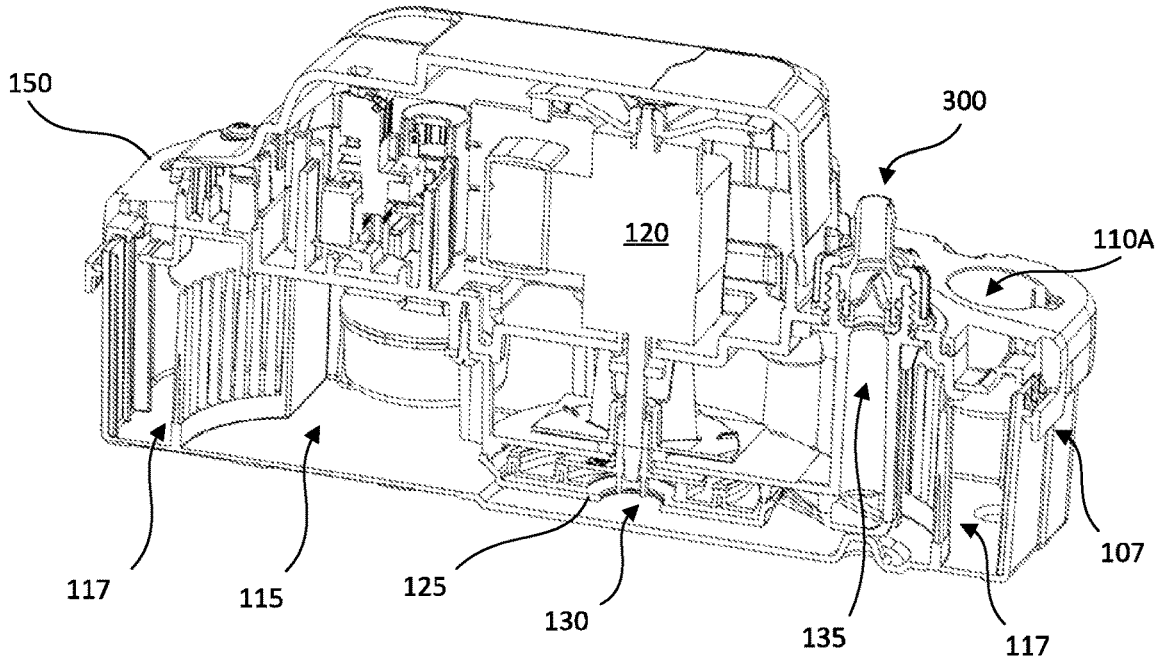

With reference to FIGS. 3 & 4, the condensate pump assembly includes multiple inlet ports 110A-110D to facilitate installation in multiple different orientations depending on the specific constraints of the installation site. The selected inlet port 110A can be opened to allow condensate to be introduced into a reservoir 115 formed in a lower section 105 of the housing. The unused inlet ports 110B-10D may remain plugged to avoid debris falling into the reservoir 115. A pump motor 120 drives an impeller housed in a pumping chamber 125 and draws condensate from the reservoir 115 through an inlet 130 and pumps the condensate out of pumping chamber 125 through an outlet member 135 and an outlet assembly 300 which is connected to a discharge line (not shown). A filter 117 is also present in the reservoir 115 which prevents larger particulate matter from reaching in the impeller. However, it would be apparent this was not essential. As shown in FIG. 4, the pump motor 120 is housed in a "dry" region of the housing between the upper section 150 and the lid 190, and the reservoir 115 is within a "wet" lower section 105 of the housing.

Figure 5:
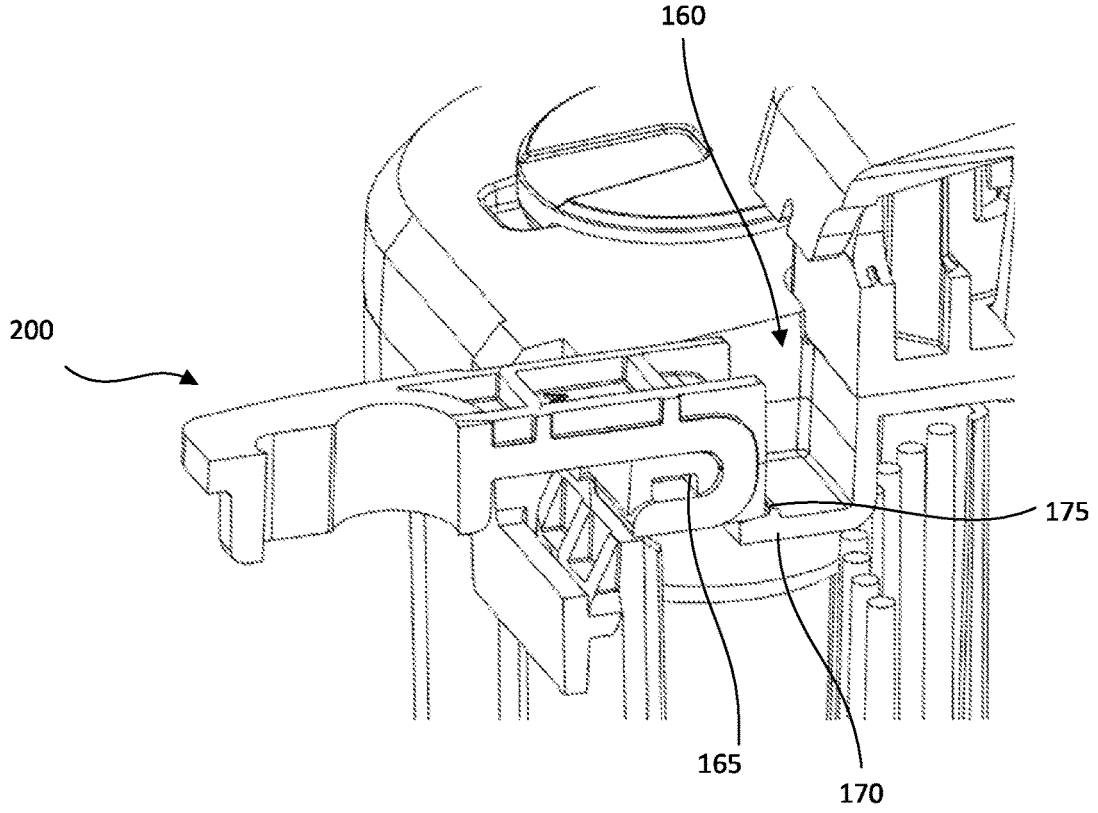
FIG. 5 illustrates a cross-sectional view of an exemplary condensate pump assembly with a clip connected thereto for mounting to a stud bar.
Figure 6B:
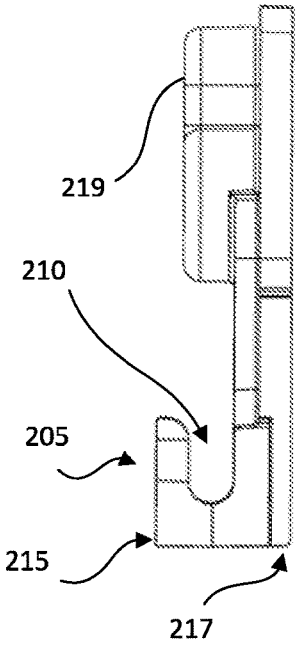
Figure 6C:
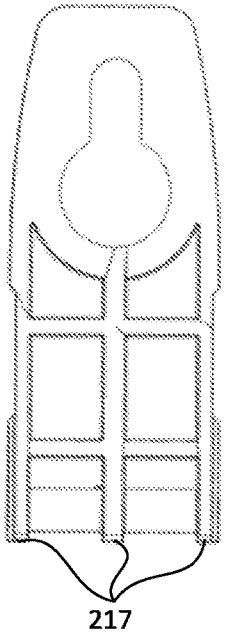

FIG. 5 illustrates cross-sectional views of the condensate pump assembly 100 with a clip 200 connected to a respective mounting portion 155A (see also FIG. 3) for mounting the condensate pump assembly 100 to a stud bar 5 (omitted from FIG. 5 for clarity). With reference to FIGS. 3 and 5, a pair of mounting portions 155A are provided at opposed sides of the upper section of the housing. The mounting portion 155A has a recess 160 for receiving a hook portion 205 of the clip 200 (see FIG. 6B). The mounting portion 155A has a resiliently deformable arm 170 which extends from one side of the recess 160 and urges the hook portion 205 against a tab 165 formed in the housing. This results in the tab 165 being received in a recess 210 defined by the hook portion 205 which secures the clip 200 to the mounting portion 155A. As shown in FIG. 6B, the clip 200 includes a shoulder 215 which corresponds to a ridge 175 formed on the resiliently deformable arm 170. The ridge 175 has a profile which corresponds to the shoulder 215 to "lock" the clip 200 in the horizontal orientation shown in FIG. 5. Ridges 217 formed on the clip 200 (see FIG. 6C) increase the stiffness of the clip 200 about an axis perpendicular to the ridges 217. This is particularly advantageous when the clips 200 are mounted in the horizontal configuration and rest on a nut fixed on the stud 5. As the load water within in the reservoir 115 can significantly increase the weight of the condensate pump assembly 100, the ridges 217 reduce the deflection of the clip 200. The distance between the aperture 220 and hook portion 205 provides sufficient space for an installer's thumb and finger to release a nut secured to the stud 5, but is not so large that the bending moment applied to the clip 200 would damage or break the clip 200 when the condensate pump assembly 100 was filled with water. When connected to the mounting portions 155A, the spacing between the apertures 220 of the clips 200 preferably match the spacing between stud bar 5 used to secure prior art pumps fixed in a similar manner, thus facilitating the replacement of condensate pump assemblies as new stud bar does not need to be provided.

Figure 7:
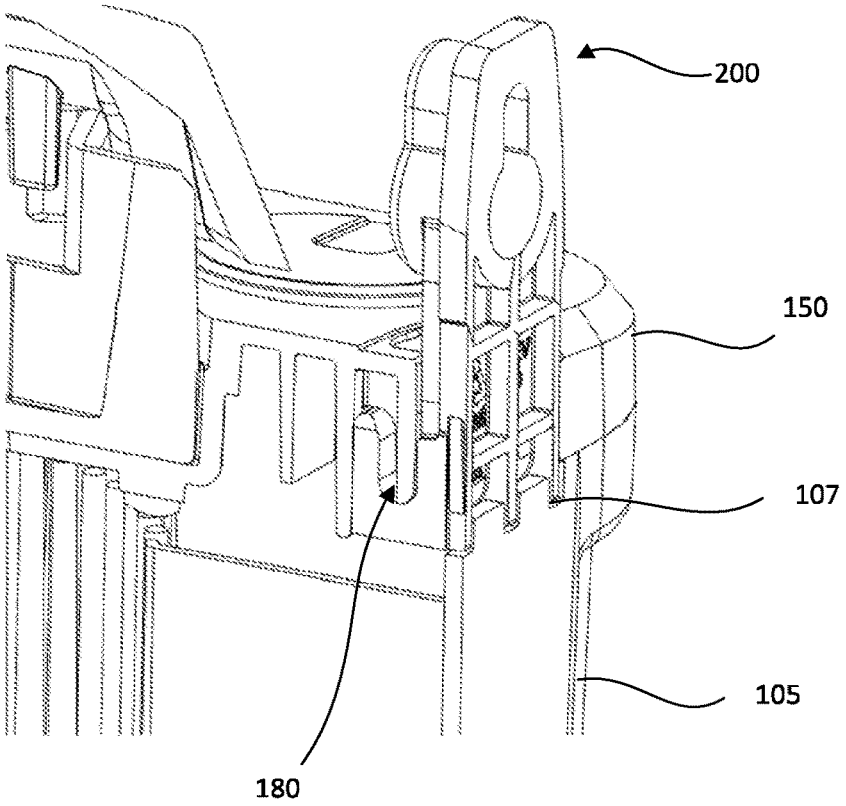
FIGS. 7 & 8 illustrate cross-sectional views of an exemplary condensate pump assembly with clips connected thereto for mounting to a planar surface.
Figure 8:
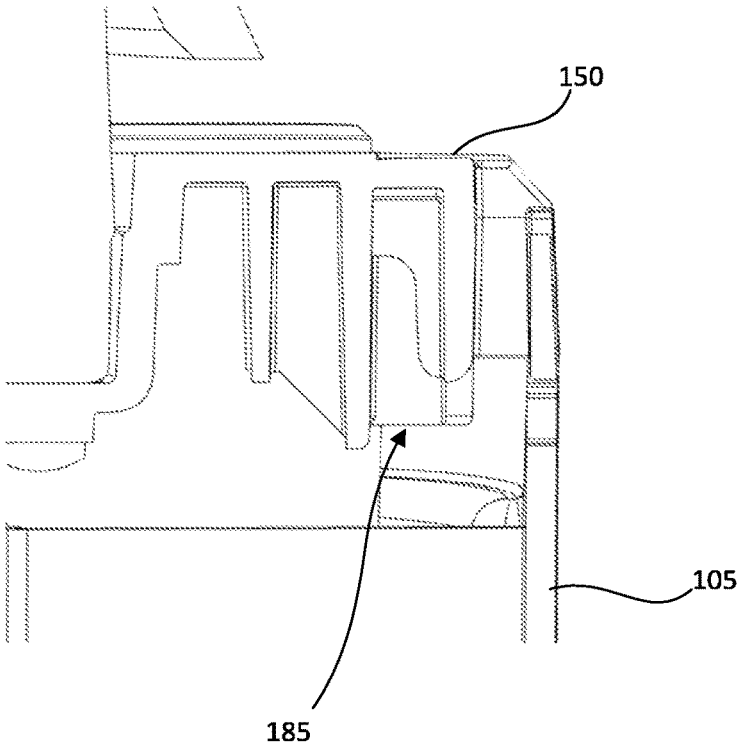

FIGS. 7 & 8 illustrate cross-sectional views of the condensate pump assembly 100 with a clip 200 connected to a respective mounting portion 155B (see also FIG. 3) for mounting the condensate pump assembly 100 to a planar surface 2 (omitted from FIG. 7 for clarity). With reference to FIGS. 3 and 7, a pair of mounting portions 155B are provided on the same side of the upper section of the housing. The mounting portion 155B has a recess 185 for receiving the hook portion 205 of the clip 200. In contrast to the mounting portions 155A, the clips 200 are secured to mounting portions 155B by the lower section 105 of the housing pressing against ridges 217 of the clip (see FIGS. 6B and 6C). The ridges 217 are formed on an opposed side of the clip 200 to the first shoulder 215. While multiple (e.g. three shown in FIG. 6C) ridges are shown, it would be apparent this was not essential, and a single ridge 217 would be sufficient. The lower portion 105 is held against the upper section 150 by a releasable snap-fit joint 107 (see FIG. 4) which provides sufficient force against the ridges 217 of the clip 200 to lock it in the vertical orientation shown in FIG. 7. The mounting portion 155B includes a tab 180 with a profile corresponding to the hook portion 205. As explained above, a screw 4 can be used to mount the condensate pump assembly in the configuration shown in FIG. 7. The spacing between the hook portion 205 and the aperture 220 is sufficient to allow a screwdriver, or other tool corresponding to the fastener 4, to engage and loosen the screw 4 to allow the condensate pump assembly 100 to be removed in the manner described above. When the clips 200 are mounted in the vertical configuration, the weight of the pump pulls downwards, parallel to the screw 4 which presses the underside of the screw head against the front-side of the clip 200 (the side facing the condensate pump assembly 100) and flexing the clip 200 downwards and open. The ridges 217 also function in this configuration to stiffen the clip 200 to limit the deflection of the clip 200. When connected to the mounting portions 155B, the spacing between the apertures 220 of the clips 200 preferably match the spacing used in prior art pumps fixed in a similar manner, thus facilitating the replacement of condensate pump assemblies as new mounting holes do not need to be drilled.

Figure 9:
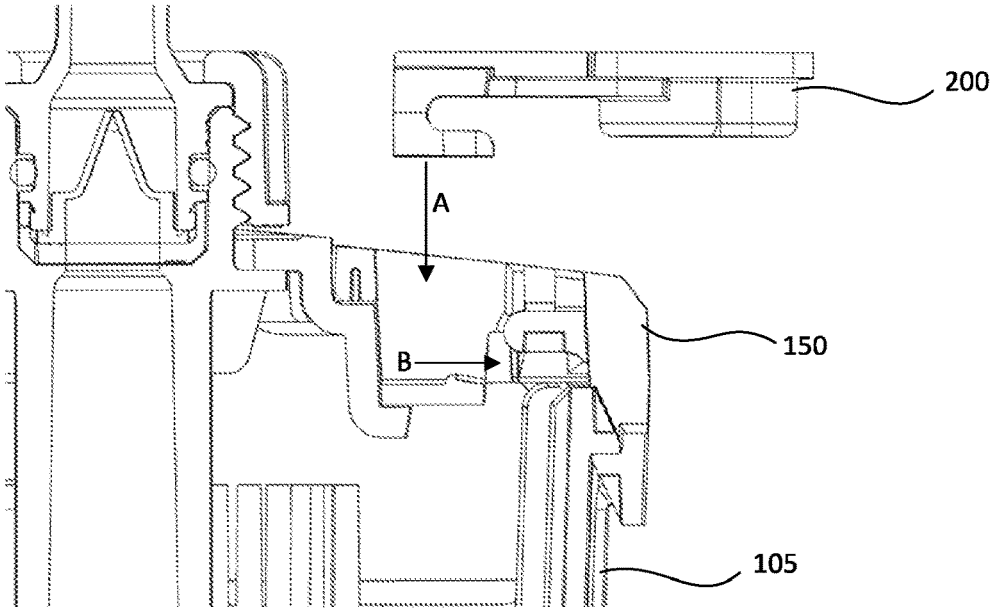
FIG. 9 illustrates an exemplary assembly process for connecting a clip to a first mounting portion.

FIG. 9 illustrates an exemplary assembly process for connecting a clip 200 to mounting portion 155A. The hook portion 205 of a clip 200 can be pressed into the recess 160 in a first direction A (shown as vertical in FIG. 9) before pressing in a second direction B (shown as horizontal in FIG. 9) to urge the hook portion 205 around the tab 165 and to lock the clip 200 in position. To release the clip 200 from mounting portion 155A, an installer can simply reverse the process, by first pushing the clip 200 towards the upper section 150 (the reverse direction of arrow B) and by lifting the clip out of the recess 160 (the reverse of arrow A).

Figure 10:
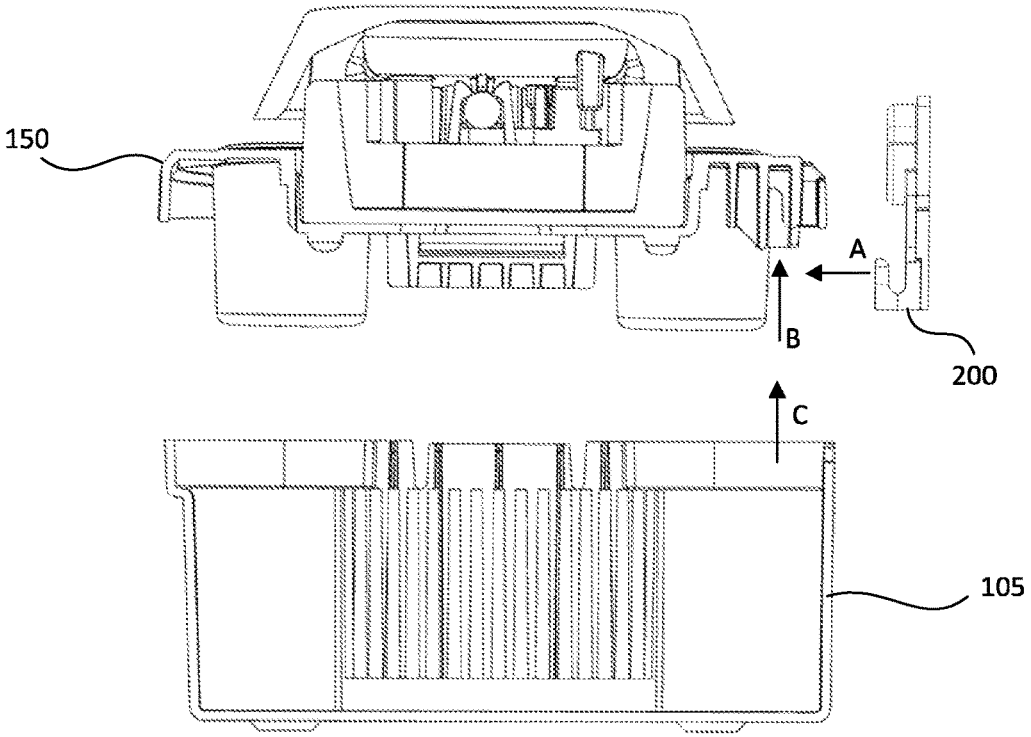
FIG. 10 illustrates an alternative exemplary assembly process for connecting a clip to a second mounting portion.

FIG. 10 illustrates an alternative exemplary assembly process for connecting a clip 200 to mounting portion 155B. Here, the installer first removes the lower section 105 to provide access to the recess 185. With the lower section 105 separated from the upper section 150, the clip is first pressed against the upper section 105 (arrow A) to position the hook portion 205 below the recess 185, and to position the raised section 219 of the clip (see FIG. 6A) in a corresponding notch 182 formed in the upper section 150 (see FIG. 3). The installer can then press the hook portion 205 into the recess 185, for example by lifting the clip 200 as indicated by arrow B. Once the hook portion 205 has abutted the tab 180 in the mounting portion 155B, the clip 200 is fully inserted into the recess 185, and the installer can re-connect the lower section 105 to the upper section 150 as indicated by arrow C. The clip 200 is clamped in position due to an upper edge of the lower section 105 pressing against the ridges 217 of the clip 200. As shown in FIG. 7, the lower section 105 may include a series of recesses corresponding to the ridges 217. This advantageously restricts relative movement between the clip 200 and the lower 105 and upper 150 sections of the housing. To release the clip 200 from the mounting portion 155B, an installer simply reverses this process, by first releasing the lower section 105 from the upper section 150 (e.g. by releasing the snap-fit joint 107), pulling the clip 200 out of the recess 185 (the reverse of arrow B) and once the raised section 219 sits in the notch 182, the hook portion 205 can be withdrawn from the recess 180 (the reverse of arrow A). While a snap-fit joint 107 is shown, it would be apparent this was not essential and other releasable joints may be used to releasably connect the lower section 105 to the upper section 150.

Figure 11A:
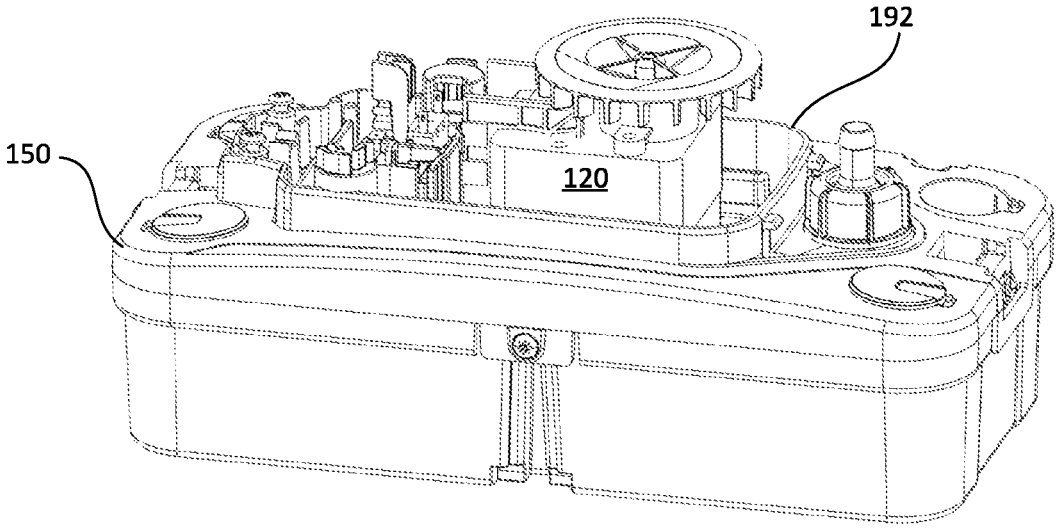
FIGS. 11A & 11B illustrate perspective and plan views of an exemplary condensate pump assembly with the lid omitted for clarity.
Figure 11B:
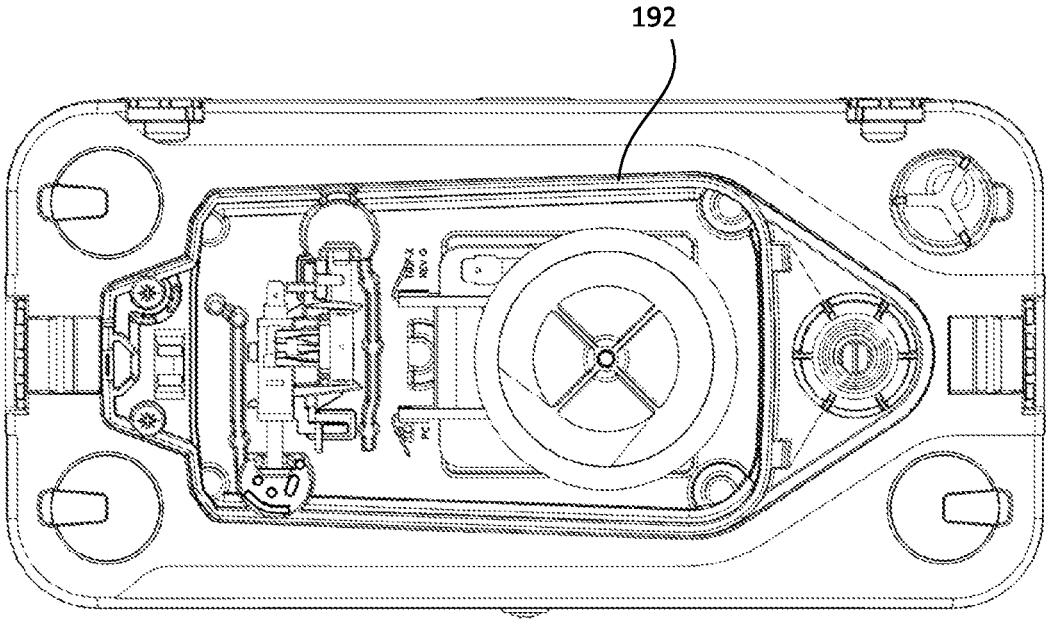

FIGS. 11A & 11B illustrates perspective and plan views of an exemplary condensate pump assembly 100 with the lid 190 omitted for clarity. As shown, the upper section 150 has a wall 192 extending from an upper surface thereof. The wall 192 substantially circumscribes the electrical components of the condensate pump assembly 100, leaving an opening for a power cable 6 (see FIGS. 1 and 2) to extend into the "dry" region of the housing defined by the lid 190 and the upper section 150. While a pump motor 120 has been described, other electrical components, such as pump motor controllers, transformers and liquid level sensors will be contained in the condensate pump assembly 100.

Figure 12:
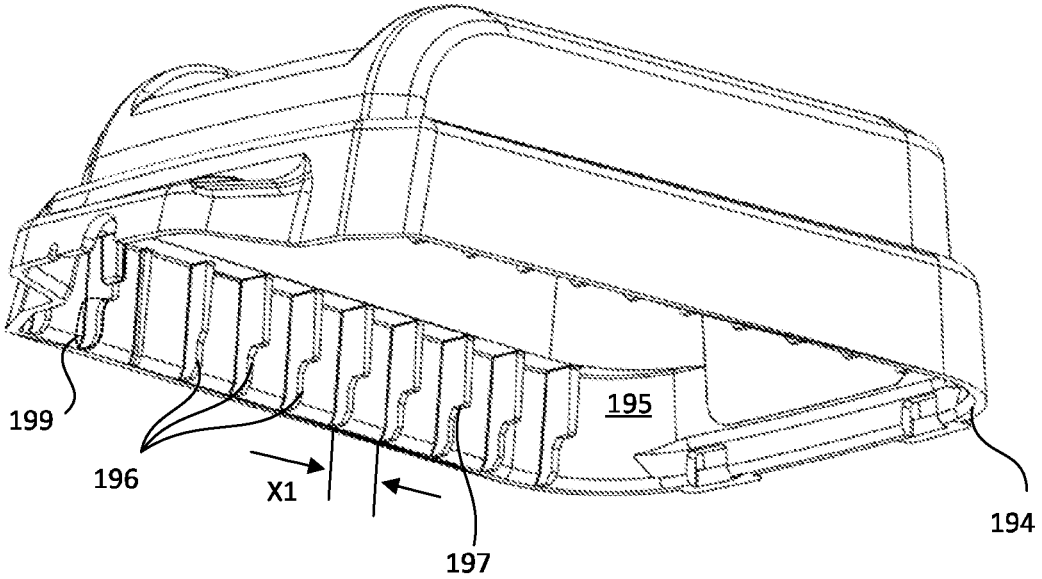
FIG. 12 illustrates an underside perspective view of an exemplary lid.
Figure 13:
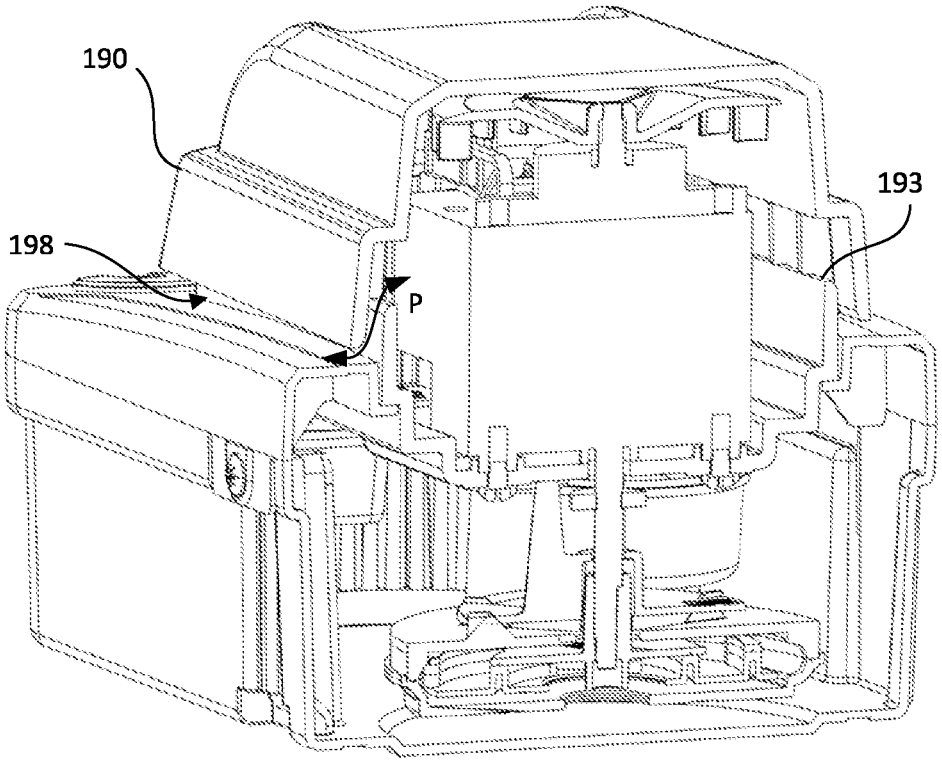
FIG. 13 illustrates a further cross-sectional view of the condensate pump assembly of FIGS. 1 and 2 with the clips omitted for clarity.

FIG. 12 illustrates a perspective view of an exemplary lid 190 which can be connected to the upper section 150, for example using a snap-fit connection. As shown in FIG. 12, a series of fins 196 are formed on an inner surface 195 of the lid 190. The fins are spaced apart from one another by a distance X1 of 13.5 mm. However, it would be apparent this was merely an example of a suitable spacing. Other distances X1 between the fins 196 may be suitable, depending on the requirements of the end user. When the lid 190 is secured to the upper section 150, a shoulder 197 of each fin 196 abuts an upper edge 193 of the wall 192 (see FIG. 13) which maintains a gap 198 between the lower edge 194 of the lid 190 and the upper section 150 and provides an air flow path P into the "dry" region. The air flow path P provides improved cooling of the electrical components. The air flow path P is serpentine as shown in FIG. 13. In some cases, the fins 196 and wall 192 may provide a labyrinth to provide a more complex air flow path, further limiting the ability of water to reach the "dry" region. The fins also include a tail portion 199 which extends from the inner surface 195 of the lid 190 towards an outer side of the wall 192 to help prevent ingress of liquid into the "dry" region.

The overhang of the lid 190 over the wall 192 preferably maintains a gap 198 between the upper section 150 and the lid 190 of between approximately 3 mm and 7 mm. As lid 190 overhangs a portion of the upper section 150 having a curved profile (see FIGS. 11A and 13), the gap 198 between the lid and the upper section 150 is not constant along the length of the lid 190. In one example, the maximum distance between the lid 190 and the upper section 150 is approximately 7 mm, for example 6.5 mm. In another example, the minimum distance between the lid and the upper section 150 is approximately 3 mm, for example 3.2 mm. It would also be apparent that the upper section 150 may have a substantially flat profile which would result in an approximately fixed gap 198 between the lid 190 and the upper section 150. The gap 198 for the air flow path also extends between the overhang of the lid 190 and the wall 192. The distance between the overhang of the lid 190 and the wall 192 is between approximately 3 mm and 4 mm, e.g. 3.5 mm, but can be independently set based on the fin 196 geometry. As shown in FIG. 12, the fins 196 do not need to have the same geometry. For example, some fins 196 may not have either or both of a shoulder 197 or tail portion 199. By increasing the distance between the upper edge 193 of the wall 192 and the lower edge 194 of the lid 190, the air flow path can be maintained while providing increased resistance to water ingress due to the longer path between the outside of the housing and the "dry" region. The larger overhang reduces the range of angles which water is able to enter the "dry" region without contacting either the lid 190 or the wall 192 and dripping back down and out of the housing. The present condensate pump assembly 100 advantageously achieves IP-X4 rating which provides splash resistance from any direction. The present condensate pump assembly 100 can therefore be reliably deployed in a wider range of sites. While the fins 196 are shown with a curved section to accommodate the cross-section of the wall 192, the shape of the fins is not essential to preventing ingress of liquid into the "dry" region. Incorporating vertical fins 196 to provide the labyrinth avoids the need for more complex arrangements which would require a more complex manufacturing and assembly process. Thus, the present design advantageously enables the lid 190 to be manufactured from a single moulding, as opposed to a two-part moulding, thus simplifying the manufacturing process.

Figure 14A:
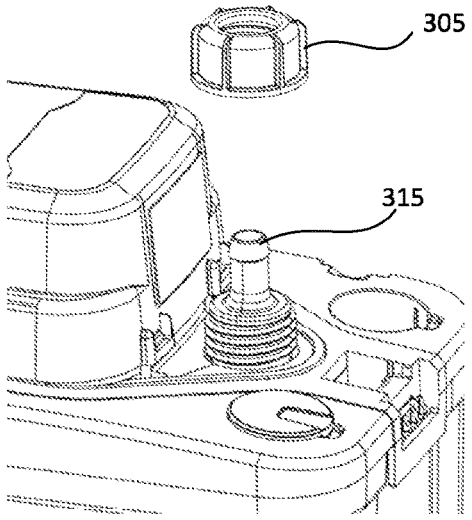
FIGS. 14A & 14B illustrate perspective and cross-sectional views of an exemplary outlet assembly connected to the condensate pump assembly.
Figure 14B:
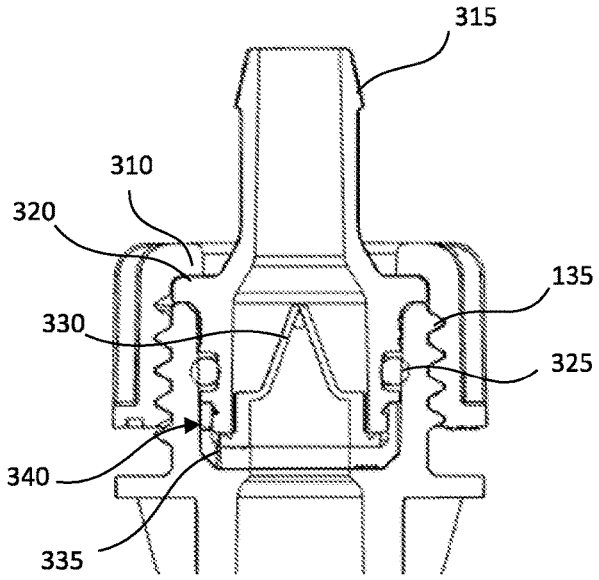

FIGS. 14A & 14B illustrate perspective and cross-sectional views of an exemplary outlet assembly 300. The outlet assembly 300 includes a locking element in the form of a nut 305, and a barbed outlet 315 designed to grip a discharge line and be releasably connected to the condensate pump assembly 100. Thus, if an installer needs to remove the condensate pump assembly or disconnect the discharge line, they are able to unlock the locking element 305 independently of the outlet member 315 and the connected discharge line. As the discharge line is often braided tube, the present outlet assembly enables the outlet member 315 to be removed with greater ease compared to existing outlet members which are one-piece outlet parts with a threaded end for connecting to the pump and a barbed end for connecting to the discharge line which require overcoming the torsional resistance generated in the discharge line as the outlet is disconnected from the pump.

The barbed outlet 315 has a shoulder 320 which allows the barbed outlet 315 to rest on the outlet 135 of the pumping chamber 125. As shown in FIG. 14B, the barbed outlet 315 extends into the pumping chamber outlet 135. A corresponding shoulder 310 formed in the nut 305 is designed to clamp the shoulder 320 to hold the barbed outlet member 315 in position. The inner diameter of the shoulder 310 maintains a space with the barbed outlet member 315 for receiving the discharge line. The pumping chamber outlet 135 has a threaded outer surface which corresponds to the internal threaded surface of the nut 305.

The outlet assembly 300 includes a piston seal 325 to provide a fluid-tight seal between the pumping chamber outlet 135 and the barbed outlet member 315. A piston seal 325 advantageously does not require a large clamping force to maintain the fluid-tight seal (e.g. a finger-tight fit is sufficient). While a piston seal 325 is described, it would be apparent this was exemplary and other seals would be suitable.

Figure 14C:
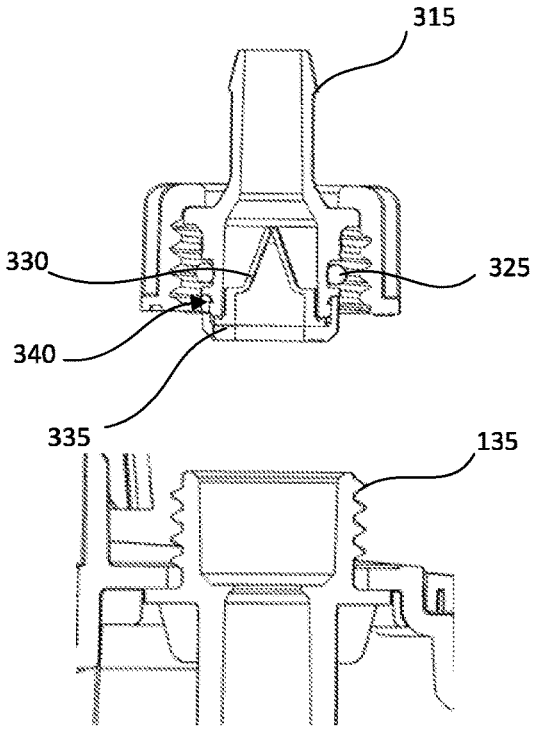
FIG. 14C illustrates the outlet assembly of FIG. 14B in a disconnected configuration.

The outlet assembly 300 also includes a one-way valve 330 (shown as a duck-billed valve in FIG. 14B). The one-way valve 330 is fixed to the barbed outlet member 315 via a clamping part 335. As shown in FIG. 14B, the locking member 315 and clamping part 355 have corresponding mechanical elements to provide a snap-fit joint 340 to ensure the clamping part 355 and the one-way valve 330 remain connected to the barbed outlet member 315 when the barbed outlet member 315 is removed from the pumping chamber outlet 135 (see FIG. 14C).

The present outlet assembly 300 therefore, prevents ingress of liquid into the pumping chamber 125 via the outlet 135 during normal operation of the condensate pump assembly 100 when the outlet assembly is connected to the pump chamber outlet 135 as shown in FIG. 14B. However, the installer may need to remove the pump from its installed location, for example, to maintain the condensate pump assembly 100. By providing a separate locking element 305 to the barbed outlet member 315, the installer can simply unlock the locking element 305, which can rotate independently of the barbed outlet member 315, and pull the barbed outlet member 315 free from the outlet 135 of the pumping chamber 125 with the discharge line, clamping part 355 and one-way valve 330 still connected to one another. As the one-way valve 330 is located in the discharge line, this stops liquid that may be present in the discharge line from spilling from the barbed outlet member 315 onto the surrounding area when the outlet assembly is disconnected from the pump chamber outlet 135, greatly reducing the risk of water damage to ducting or other nearby appliances, or onto the condensate pump assembly 100 itself.

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A condensate pump assembly comprising:

a housing having an inlet port, a reservoir arranged to receive liquid through the inlet port, and an outlet port having an outlet assembly mounted thereto, a pump arranged to pump liquid from reservoir to the liquid outlet assembly, and clips releasably connectable to the housing at a first pair of mounting portions and a second pair of mounting portions, wherein each of the clips have a first portion for connecting to a first external element and a second portion for connecting to a second external element, wherein the clips are configured to mount the housing to the first external element when connected to the first pair of mounting portions, the clips are configured to mount the housing to the second external element when connected to the second pair of mounting portions, and the clips are arranged in a first orientation when connected to the first pair of mounting portions, and are arranged in a second orientation when connected to the second pair of mounting portions.

2. A condensate pump assembly as claimed in claim 1, wherein each clip includes a hook portion for engaging a corresponding tab portion of the housing.

3. A condensate pump assembly as claimed in claim 2, wherein any of the first pair of mounting portions and second pair of mounting portions includes a recess arranged to receive the hook portion of a respective clip in a first direction and allow the clip to translate in a second direction different to the first direction so as to engage the tab portion.

4. A condensate pump assembly as claimed in claim 2, wherein the first pair of mounting portions includes a resiliently deformable member arranged, in use, to urge the hook portion against the tab portion.

5. A condensate pump assembly as claimed in claim 1, wherein each of the clips includes an aperture having a first portion having a profile corresponding to the first external element and a second portion having a profile corresponding to the second external element.

6. A condensate pump assembly as claimed in claim 1, wherein the housing includes a lower section including the reservoir and an upper section, and wherein the first pair of mounting portions and second pair of mounting portions are formed in the upper section.

7. A condensate pump assembly as claimed in claim 1, wherein the first pair of mounting portions are arranged on opposed sides of the housing.

8. A condensate pump assembly as claimed in claim 1, wherein the second pair of mounting portions are arranged on a side of the housing.

9. A condensate pump assembly as claimed in claim 1, wherein the pump is arranged to pump liquid to the outlet assembly through a pumping chamber of the housing, the pumping chamber has an outlet extending through the outlet port to connect to the outlet assembly, and the outlet assembly includes an outlet member for connecting to a discharge line and a locking element arranged to releasably engage the outlet of the pumping chamber so as to releasably secure the outlet member to the outlet of the pumping chamber.

10. A condensate pump assembly as claimed in claim 1, wherein the housing includes an upper section and a lid mounted to the upper section, the condensate pump assembly includes a pump motor mounted on the upper section and arranged to drive the pump, and a gap is maintained between the lid and the upper section such that air can flow to the pump motor from outside the housing.

* * * * *